United States Patent [19]

Fehling

[11] 4,227,630

[45] Oct. 14, 1980

[54] SLIDING GATES FOR METALLURGICAL VESSELS

[75] Inventor: Hans R. Fehling, Geneva, Switzerland

[73] Assignee: Didier-Werke AG, Wiesbaden, Fed. Rep. of Germany

[21] Appl. No.: 923,241

[22] Filed: Jul. 10, 1978

[30] Foreign Application Priority Data

Jul. 15, 1977 [DE] Fed. Rep. of Germany ..... 2732094

[51] Int. Cl.[2] ..... B22D 41/08

[52] U.S. Cl. ..... 222/600; 251/326

[58] Field of Search ..... 222/600, 598, 590, 592, 222/561; 106/58; 251/326; 137/375

[56] References Cited

U.S. PATENT DOCUMENTS

| | | | |
|---|---|---|---|
| 3,501,068 | 3/1970 | Shapland | 222/600 X |
| 3,709,411 | 1/1973 | Shapland | 222/600 |
| 3,841,539 | 10/1974 | Shapland, Jr. et al. | 222/600 |
| 3,866,806 | 2/1975 | Shapland, Jr. | 222/600 |

*Primary Examiner*—David A. Scherbel

*Attorney, Agent, or Firm*—Stevens, Davis, Miller & Mosher

[57] ABSTRACT

There is disclosed a frame for a sliding gate, which in use holds the movable and fixed plates against each other under pressure and which is formed of refractory concrete reinforced with metal elements which are screened from the molten metal by the refractory concrete.

14 Claims, 7 Drawing Figures

Fig. 2
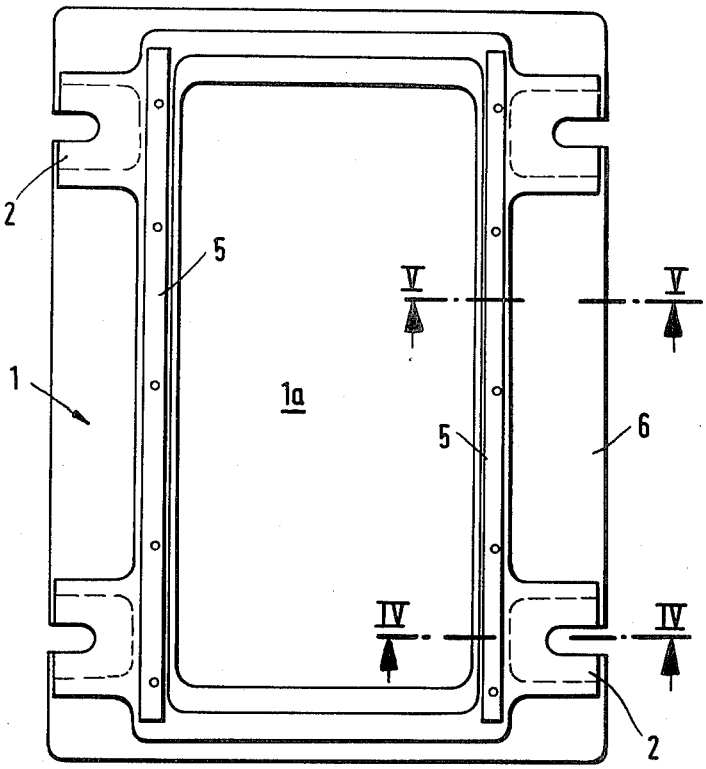
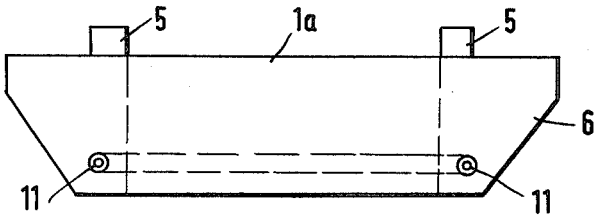
Fig. 3

SLIDING GATES FOR METALLURGICAL VESSELS

BACKGROUND OF THE INVENTION

The invention relates to a sliding gate for metallurgical vessels, more particularly steel pouring ladles.

Sliding gates of the aforementioned kind usually comprise a housing, usually box-shaped, firmly secured to the vessel and containing two refractory plates, each having an outlet opening and movable in a straight line or in rotation relative to one another, one plate being stationary and the other movable. The two plates are secured at a pressure suitable for sealing by an externally attached frame or cover, which will be referred to herein as the frame, which can be secured to the housing. The frame has a large central recess through which an outlet jacket (or immersion tube) for the metal melt (e.g. steel) extends. The frame is made of metal, more particularly steel, and can have sliding ledges or sliding surfaces on which the movable plate can be moved to open or close the gate.

During operation, the frame is subjected to considerable mechanical and thermal stresses. The original prestress is increased, in a manner difficult to predict, by the thermal expansion at the centre of the plate which occurs during casting. The frame is internally heated by the hot parts of the gate and, more particularly, is exposed to severe heat radiation from the jet of cast metal and, possibly, reflection from the poured metal melt. These stresses, increase with the length of casting and the size of the sliding gate. The parts subject to wear have to be installed or removed very frequently, thus heating or cooling the frame or cover, which also has a disadvantageous effect.

DESCRIPTION OF THE PRIOR ART

These stresses may seriously affect the reliability of the sliding gate and in all cases result in shortening the life of the frame or cover. Attempts have been made to reduce these stresses. The final result has been to cover the underside of the frame or cover by an anti-radiation box. This, however, is very inconvenient in operation. Attempts have also been made at using better, more heat-resistant steel. This helps but is expensive.

Attempts have also been made to cool the frame or cover by air, but the efficiency is low owing to the lack of an air supply.

SUMMARY OF THE INVENTION

An object of the invention is to construct a slidng gate for metallurgical vessels comprising a frame which is free from the aforementioned disadvantages and substantially protected against stress from heated parts of the gate or severe heat radiation from the jet of cast metal or radiation from the cast melt, and has an increased working life.

To this end, the invention provides a sliding gate for an outlet of a metallurgical vessel comprising two plates each having an outlet opening, one plate being stationary and the other movable, comprising a frame which secures the plates at the pressure required for sealing, the frame or cover comprising a refractory concrete member reinforced with metal elements.

DESCRIPTION OF THE PREFERRED EMBODIMENTS

According to one embodiment of the invention, a metal frame is embedded in the refractory concrete member, which covers at least the inner, outer and under sides of the frame but does not cover any lateral securing lugs or the like.

According to a special embodiment of the invention, the upper side of the metal frame is covered by parts of the concrete member.

The metal elements are embedded in the refractory concrete so as to be protected against excessive heating by radiation or convection.

Optionally, the resilient concrete member has cooling ducts for a gaseous or liquid cooling medium or for circulating a medium which can be evaporated and condensed.

Ground sliding surfaces or sliding rails can be embedded in the portion forming the upper side of the refractory concrete member, in order to bear the movable plate.

DESCRIPTION OF THE DRAWINGS

The invention can be put into practice in various ways and a number of embodiments of the invention and one embodiment of the prior art will be described by way of example to illustrate the invention with reference to the accompanying drawings in which:

FIG. 2 is a plan view of an embodiment of a frame according to the invention;

FIG. 3 is a side view of the frame shown in FIG. 2;

DETAILED DESCRIPTION OF THE INVENTION

Figure 1:
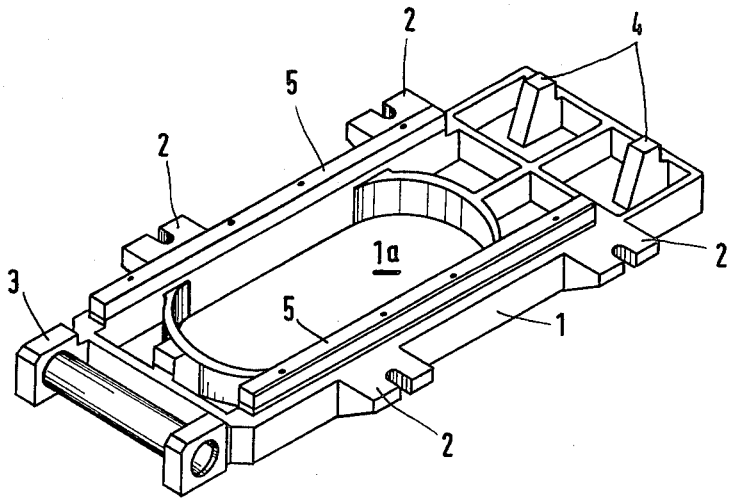
Fig. 1 Prior Art
FIG. 1 is a perspective view of a known removable frame for a large sliding gate.

FIG. 1 shows a known metal or steel frame for a large sliding gate. The frame 1 has an elongate outlet opening 1*a* through which the outlet jacket (or tube) of the reciprocatable sliding plate can extend from above. The frame 1 comprises a single steel casting having four lugs or the like 2 adapted for engagement by securing screws. Other known frames have e.g. six lugs. The frame in FIG. 1 is pivoted by a hinge 3 to the stationary sliding-gate housing so that it can be swung up and down. Two projections 4 serve as abutments when the frame is swung up to the housing. Two exchangeable sliding rails 5 are secured to the frame so that the sliding plate can move on them.

It can be seen that, as stated hereinbefore, most of the frame surface is subjected to considerable heat radiation from the flowing jet or steel and/or the surface of a steel melt poured out under the frame, e.g. into a tundish or an intermediate vessel.

FIGS. 2 and 3 are views of an embodiment of the frame according to the invention. In FIGS. 2 and 3, some of the steel parts correspond to those in the known embodiment in FIG. 1, e.g. the removable frame having an outlet opening 1*a*, the lugs 2 and the sliding rails 5. However, the frame 1 is lighter and is permanently embedded in a concrete member 6 which almost completely protects the steel frame 1 from direct radiation. If required, the frame can also have a hinge as shown in FIG. 1.

Figure 4:
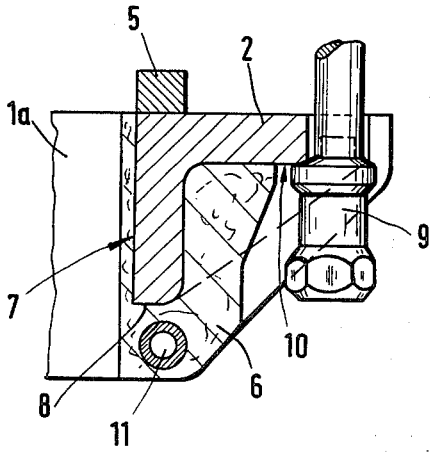
FIG. 4 is a cross-sectional view along line IV—IV in FIG. 2.
Figure 5:
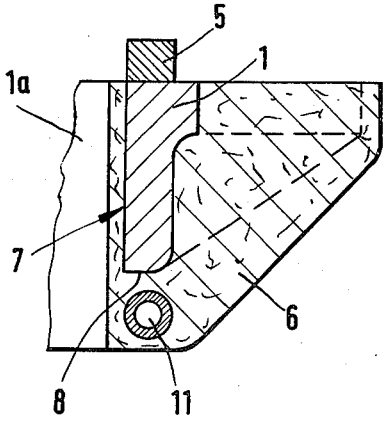
FIG. 5 is a cross-sectional view along line V—V in FIG. 2.

The protection against radiation is shown in detail in FIGS. 4 and 5. The concrete member 6 covers both the interior of the frame surface 7 facing the outlet opening 1*a* and also the underside 8, the only part left uncovered being the steel surface 10 of lugs 2, against which abut the retaining screws 9.

In order to increase the protection against heat and to cool the entire frame, cooling ducts or tubes 11 can be formed in the concrete member and, as shown in FIG. 3, can be disposed along all four sides of the frame. Any suitable cooling agents or cooling method can be used. A preferred arrangement is to blow air through the ducts.

Figure 6:
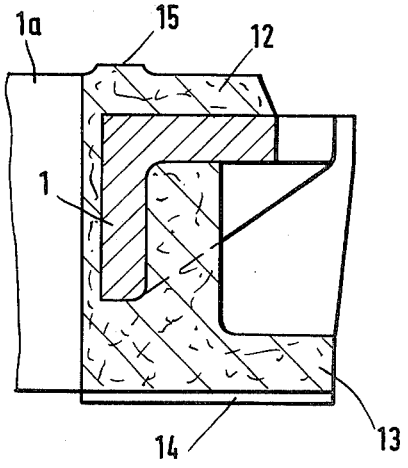
FIG. 6 is a cross-sectional view, corresponding to FIG. 4, of another embodiment in accordance with the invention.

FIG. 6 shows a variant of the frame shown in FIG. 4, the frame being protected above by a concrete layer 12 and below by additional lateral projections or flanges 13, which also protect the nuts from direct radiation. Additional insulation can be provided by an embedded layer of refractory felt 14. In the last-mentioned embodiment, the sliding rails are replaced by ground sliding surfaces 15.

Figure 7:
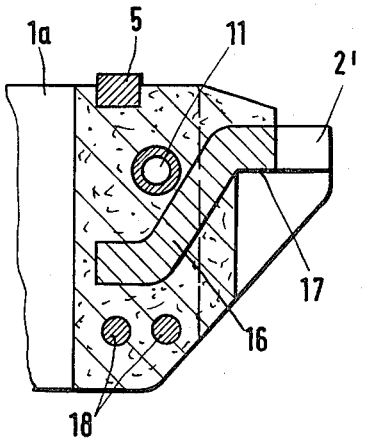
FIG. 7 is a cross-sectional view of another embodiment in accordance with the invention.

FIG. 7 is a cross-sectional view of the parts, corresponding to FIG. 4, of another embodiment of the invention. FIG. 7 does not show a one-piece frame. The required steel parts are individually embedded in the concrete frame. A securing lug 2' is constructed as a steel anchor 16, only the abutment surface 17 of which projects from the concrete member. The sliding rails 5 (or the associated retaining strips, if the rails are replaceable) are likewise permanently embedded. In addition, reinforcing members 18 are inserted in the lower part of the concrete member 6 and receive the tensile stresses caused by the pressure and motion of the sliding gate. If high bending stressed are likely, angle or V-iron members are preferably embedded along the long sides so that the rails can be secured thereto. Cooling ducts 11 can extend through the middle of the concrete member.

Individual features of FIGS. 5 to 7 can be combined in a variety of different ways.

The term "refractory concrete" used in this description refers to a concrete which does not significantly change volume under the radiation conditions of a steel melt, more particularly a concrete based on hydraulic-setting mixtures containing fused alumina cement.

The following are examples of refractory concretes suitable for manufacturing the reinforced refractory concrete member according to the invention.

EXAMPLE 1

80% by weight of an aggregate containing 40% by weight $Al_2O_3$ and having a particle size of 0 to 5 mm are mixed with 20% by weight of a fused alumina cement containing 40% by weight $Al_2O_3$, 12 liters of water being added per 100 kg of dry mix.

The mix is poured into a mould and is compacted by vibration should this be desirable.

The parts of the metal reinforcement were inserted and the resulting concrete member, after having sufficiently set, is removed from the mould, and stored for further curing and dried.

EXAMPLE 2

80% by weight of Guyana bauxite containing 88% by weight of $Al_2O_3$ and having a particle size of 0 to 5 mm was mixed with 20% by weight of alumina cement containing 70% by weight $Al_2O_3$ and 10 liters of water was added per 100 kg of dry mix. The mix was further processed as in Example 1.

If the parts are to be used for casting steel having a melting point above 1500° C. and a pouring temperature 50° to 60° C. above the melting point, the concrete members have to withstand more severe conditions, and for greater reliability, it is advantageous to use special compositions for the concrete members.

For such very severe conditions it is preferred to use refractory concrete having substantially the following composition:

5 to 8% by weight of alumina cement, 2.5 to 4% by weight of at least one pulverulent refractory material having particle size less than 50 microns and preferably less than 1 micron), such as kaolin or bentonite, micronised silica, micronised alumina, micronised magnesia, micronised chromite or micronised forsterite, 0.01 to 0.3% by weight of a thinning agent containing inter alia an alkali-metal phosphate, an alkali-metal polyphosphate, an alkali-metal carbonate, an alkali-metal carboxylate or an alkali-metal humate, and 87.7 to 92% by weight of at least one refractory aggregate, preferably having a maximum particle size of less than 30 mm, all the particles preferably passing through a 10 mm mesh and about 25% of which pass through a 0.5 mm mesh. The refractory aggregate can comprise the following substances: calcined refractory clay, bauxite, cyanite, sillimanite, andalusite, corundum, tabular alumina, silicon carbide, magnesia, chromite, zircon or mixtures thereof.

The following is an example of the aforementiond refractory concrete:

EXAMPLE 3

87.7 to 92% by weight of tabular alumina, particle size 0 to 6 mm, are mixed with 5 to 8% by weight of alumina cement containing approximately 80% by weight of $Al_2O_3$, 2.5 to 4% by weight of micronised alumina and 0.1 to 0.3% by weight of alkali-metal polyphosphate. 5 liters of water were added per 100 kg of dry mix. The mix is poured into a mould and can be compacted by vibration.

If required, the concrete member can have inserts of a different ceramic material embedded in the refractory concrete. For example the outlet opening can be an embedded insert of refractory material such as fire-clay or magnesite.

What I claim as my invention and desire to secure by Letters Patent is:

1. A frame for a sliding gate for an outlet of a metallurgical vessel comprising a refractory concrete member reinforced with at least one metal element having at least one lateral securing lug, said metal element being a metal frame embedded in the refractory concrete member, said concrete covering the inner, outer and under sides of the frame up to the lateral securing lug.

2. A frame as claimed in claim 1 in which the refractory concrete member also covers the upper side of the metal frame.

3. A frame as claimed in claim 2 in which the portion of the refractory concrete member covering the upper side of the metal frame has raised, ground, sliding surfaces for bearing the movable plate.

4. A frame as claimed in claim 2 in which sliding rails for bearing the movable plate are embedded in the portion of the refractory concrete member which covers the upper side of the metal frame.

5. A frame as claimed in claim 1 in which the refractory concrete member has cooling ducts disposed in it.

6. A frame as claimed in claim 5 in which the cooling ducts extend peripherally around the concrete member.

7. A frame as claimed in claim 1 in which the concrete member has a refractory layer of refractory felt embedded in its underneath surface which is exposed to radiation from a poured metal melt.

8. A frame as claimed in claim 1 in which the metal frame embedded in the concrete member is a single piece.

9. A frame as claimed in claim 1 comprising a number of metal parts which are embedded in the concrete member together with securing lugs and associated retaining parts.

10. A frame as claimed in claim 9 in which the securing lugs are secured to metal anchors.

11. A frame as claimed in claim 1 in which the concrete member contains reinforcing parts.

12. A frame for a sliding gate for an outlet of a metallurgical vessel comprising a refractory concrete member reinforced with at least one metal element having at least one lateral securing lug in which the underside of the concrete member has a lateral projection which is spaced apart from the lateral lug at a distance such as to facilitate assembly and protect the lug against heat radiation from under the outlet by a poured metal melt.

13. A frame as claimed in claim 12 in which the lateral projection has a shape corresponding to the outline or shape of the lug and has the same or larger dimension than the projecting surface of the securing lug.

14. A sliding gate for a metallurgical vessel incorporating a frame or cover as claimed in claim 1 or claim 2 or claim 3 or claim 4 or claim 5 or claim 6 or claim 12 or claim 13 or claim 7 or claim 8 or claim 9 or claim 10 or claim 11.

* * * * *